US007837189B2

(12) United States Patent
Young et al.

(10) Patent No.: US 7,837,189 B2
(45) Date of Patent: Nov. 23, 2010

(54) ELASTOMER GRIPPING BELT LOOP FOR A DISC STACKER SYSTEM

(75) Inventors: Herman Young, Williamson, NY (US); Richard P. Ficarra, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/429,651

(22) Filed: Apr. 24, 2009

(65) Prior Publication Data

US 2010/0270736 A1 Oct. 28, 2010

(51) Int. Cl.
*B65H 29/00* (2006.01)

(52) U.S. Cl. ..... 271/187; 271/315

(58) Field of Classification Search ..... 271/187, 271/314

See application file for complete search history.

(56) References Cited

U.S. PATENT DOCUMENTS 5,476,256 A * 12/1995 Fortuna et al. ..... 271/187
5,975,525 A * 11/1999 Hartmann et al. ..... 271/315
6,019,209 A * 2/2000 Hara et al. ..... 194/206
7,017,900 B2 * 3/2006 Dobrindt ..... 271/187
2004/0251622 A1 * 12/2004 Dobrindt ..... 271/315

* cited by examiner

*Primary Examiner*—David H Bollinger
(74) *Attorney, Agent, or Firm*—Ronald E. Prass, Jr.; Prass LLP

(57) ABSTRACT

According to aspects of the embodiments, there is provided a printing system the use of an elastomer belt that would flex during media insertion, yet would be positioned and constructed such to prevent the media from escaping the pinch created by the gripper belt. The gripping force, created by the elastomer belt, increases if the sheet attempts to be removed via the orientation and mechanical advantage of the belt construction. This system also incorporates a feature to reduce the gripper belt holding force by means of a mechanical linkage actuated by a counter weighted, cam system or possibly an electromechanical device. The elastomer belt would eliminate any marks or scuffs on the media when it is removed from the disk stacker.

18 Claims, 5 Drawing Sheets

ELASTOMER GRIPPING BELT LOOP FOR A DISC STACKER SYSTEM

BACKGROUND

This disclosure relates in general to copier/printers, and more particularly, to printing systems having a disk type stacker with non-corrugated sheet carrying slots.

In many automatic copying or printing machines, rotating disk stackers are often used for providing combined media inversion and stacking of output copy media. In a typical rotating disk stacker, copy media are sequentially transported into an arcuate receiving slot on a rotating disk. The copy media lead edge is inserted into the receiving slot and the copy media is temporarily maintained in contact with the rotating disk such that the rotating movement of the disk flips the media over and simultaneously guides the inverted media into a collecting tray.

A corrugation feature is usually included in the receiving slot in order to prevent media slippage, media skewing or the like as the media are being manipulated in the rotating disk stacker. The corrugation features are designed to automatically increase the retention of the media within the media transporting slot in proportion to the stiffness of the media. The corrugation feature, however, tends to create an interference force upon the media when inserted in the receiving slot. This interference pattern becomes more pronounce as smooth coated media is inserted tamped axially or removed resulting in a visible defect.

For the reasons stated above, and for other reasons stated below which will become apparent to those skilled in the art upon reading and understanding the present specification, there is a need in the art for a rotating disk stacker that does not create a visible defect such as an interference pattern.

SUMMARY

According to aspects of the embodiments, there is provided a printing system the use of an elastomer belt that would flex during media insertion, yet would be positioned and constructed such to prevent the media from escaping the pinch created by the gripper belt. The gripping force, created by the elastomer belt, increases if the sheet attempts to be removed via the orientation and mechanical advantage of the belt construction. This system also incorporates a feature to reduce the gripper belt holding force by means of a mechanical linkage actuated by a counter weighted, cam system or possibly an electromechanical device. The elastomer belt would eliminate any marks or scuffs on the media when it is removed from the disk stacker.

DETAILED DESCRIPTION

Figure 1:
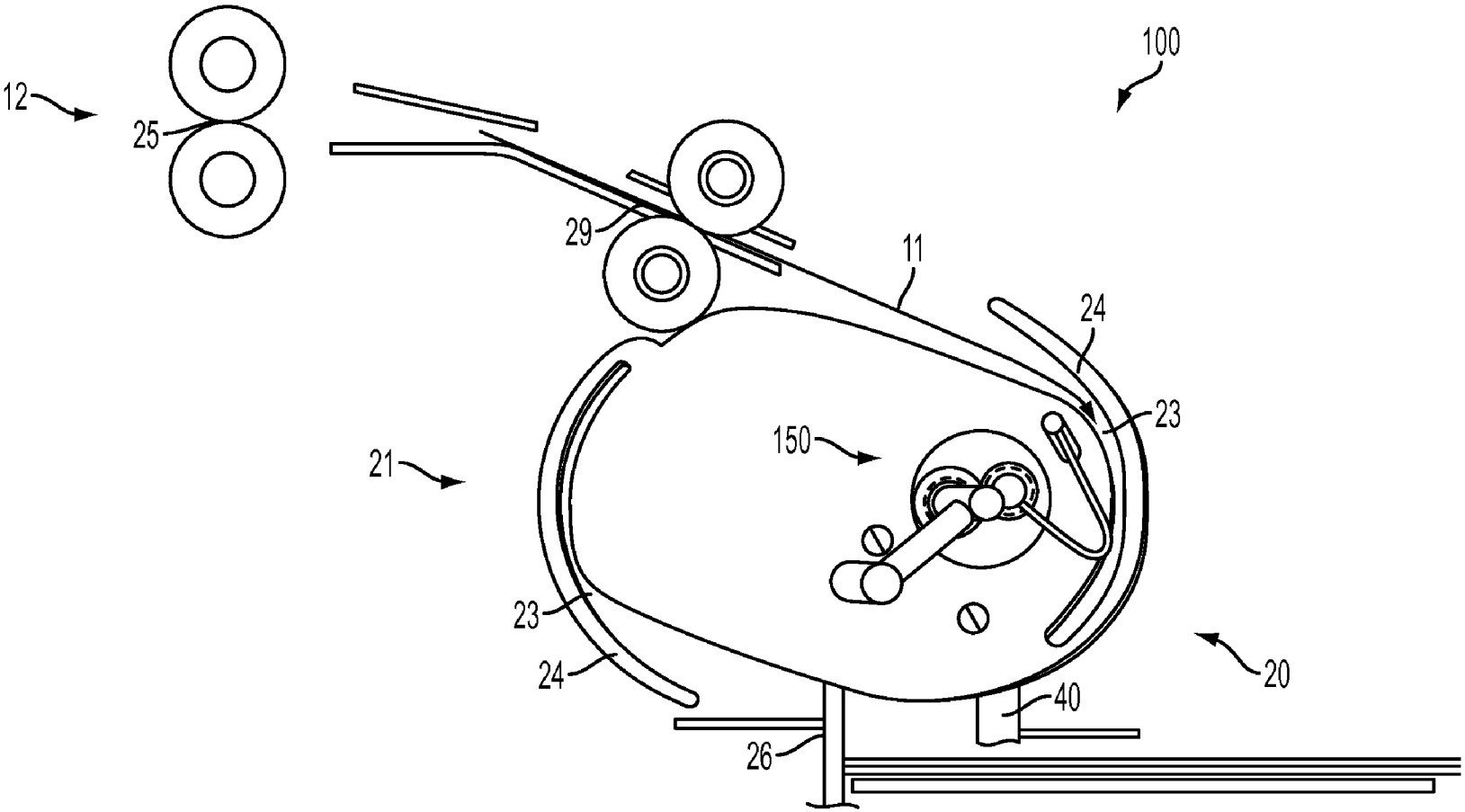
FIG. 1 is a schematic side view of a disk stacking system with gripper belt loop, showing a print media entering a rotating disk in accordance to an embodiment.

Aspects of the disclosed embodiments relate to an apparatus to reduce/eliminate scuffs or marks on a media when it is removed from a disk stacker in a print system. The proposed stacker incorporates a gripper surface that is positioned to exert a force on a media received within a slot in the rotational element of the disk stacker. A mechanical linkage actuated by a counter weighted, cam system or possibly an electromechanical device is used to vary the exerted force on the media.

The disclosed embodiments include a rotational element with at least one slot for receiving a stackable item, a feed mechanism for feeding the stackable item into the slot, a gripper surface made from an elastomer material or the like for holding the media in place, a mechanical linkage connected to the gripper surface for varying the holding force, and a cam and gear assembly for translating the movement of a mechanical arm to an appropriate force for holding the stackable item in place.

The disclosed embodiments further include a printing system having a tray for receiving a printed media from a media stacker. The media stacker comprises a rotational element with at least one slot, a gripper surface for holding the printed media in the slot, and a mechanical linkage to vary the holding force on the print media. The mechanical linkage can be actuated by a counter weighted, cam system or possibly an electromechanical device. Further, a disclosed embodiment includes a first and a second post configured to limit the holding force to within an upper and lower limit.

Embodiments as disclosed herein may also include computer-readable media for carrying or having computer-executable instructions or data structures stored thereon for operating such devices as controllers, sensors, and electromechanical devices. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

The term "mechanical linkage" as used herein is any device that causes a cam to rotate which in turn causes a gripping surface to vary its position relative to a plane or surface. Components of a mechanical linkage can comprise any material such as plastic, metal, or wood.

The term "print media" generally refers to a usually flexible, sometimes curled, physical sheet of paper, plastic, or other suitable physical print media substrate for images, whether precut or web fed.

The term "printing system" as used herein refers to a digital copier or printer, bookmaking machine, facsimile machine, multi-function machine, or the like and can include several marking engines, as well as other print media processing units, such as paper feeders, finishers, and the like.

FIG. 1 illustrates the basic components of an exemplary printer system output section comprising a print media transport and delivery module 100 that typically receives output from one or more print media 11 through a feeder section 12 via feed rollers 25. This feeder section 12 can represent a conventional high-speed copier or printer. The print media transport and delivery module 100 includes a disk stacker section comprising a rotating disk unit 20 having one or more disks 21. Each disk 21 has one or more arcuate fingers 24 located along its periphery defining arcuate receiving slots 23 for receiving output print media 11 therein.

By way of description of the operation of a typical disk stacker, a print media 11 exits an upstream device, such as a print system or copier through output rollers (not shown), entering the disk stacker module 100 through feeder section 12 where the sheet is engaged by one or more pairs of disk stacker input rollers 25. The print media 11 is then transported into contact with input rollers 29, which drive the sheet into receiving slot 23 of disk 21. The print media or sheet received in slot 23 is secured by gripper belt loop mechanism 150. After a sheet is fed into a receiving slot 23, the disk 21 rotates to invert and transport the sheet until the leading edge of the sheet is positioned against a fixed registration wall 26. The registration wall 26 strips the sheet from the rotatable disk 21 as the disk continues to rotate through openings in the fixed wall 26, thereby allowing the sheet to drop onto the top of a stack of previously inverted sheets, as shown. Various conventional devices known in the art, such as a stepper motor or a cam drive mechanism can control the rotational movement of disk unit 20. Preferably, a sensor is located upstream of disk unit 20 for detecting the presence of a sheet approaching disk unit 20. The disk input rollers 29 operate at a constant velocity (V) such that the time (t) required for the sheet lead edge to reach the disk slot 23 after detection by the sheet sensor can be easily determined. Thereafter, as the lead edge of sheet 11 begins to enter slot 23, the disk rotates through a 180 degree cycle.

A tamping mechanism 40 tamps each incoming print media sideways (laterally) into its proper stack, without tamping the stack edge so as not to interfere with plural sets offsetting. All incoming print media are so tamped one at a time. The illustrated lateral tamper system 40 for the incoming print media is shown here as being driven by a cam (not shown) via pivotal lever arms from the print media input drive system. Although it could also be operated by a solenoid, and spring loaded in the outboard or non-tamping position, preferably the tamper 40 motion is ramped to have a controlled acceleration movement by the cam or the like in order to control print media inertia better. The shape of the tamper drive cam system can provide better control of print media inertia. For variable print media length end tamping, a multi-position tamper with a programmable stepper motor can be used.

Figure 2:
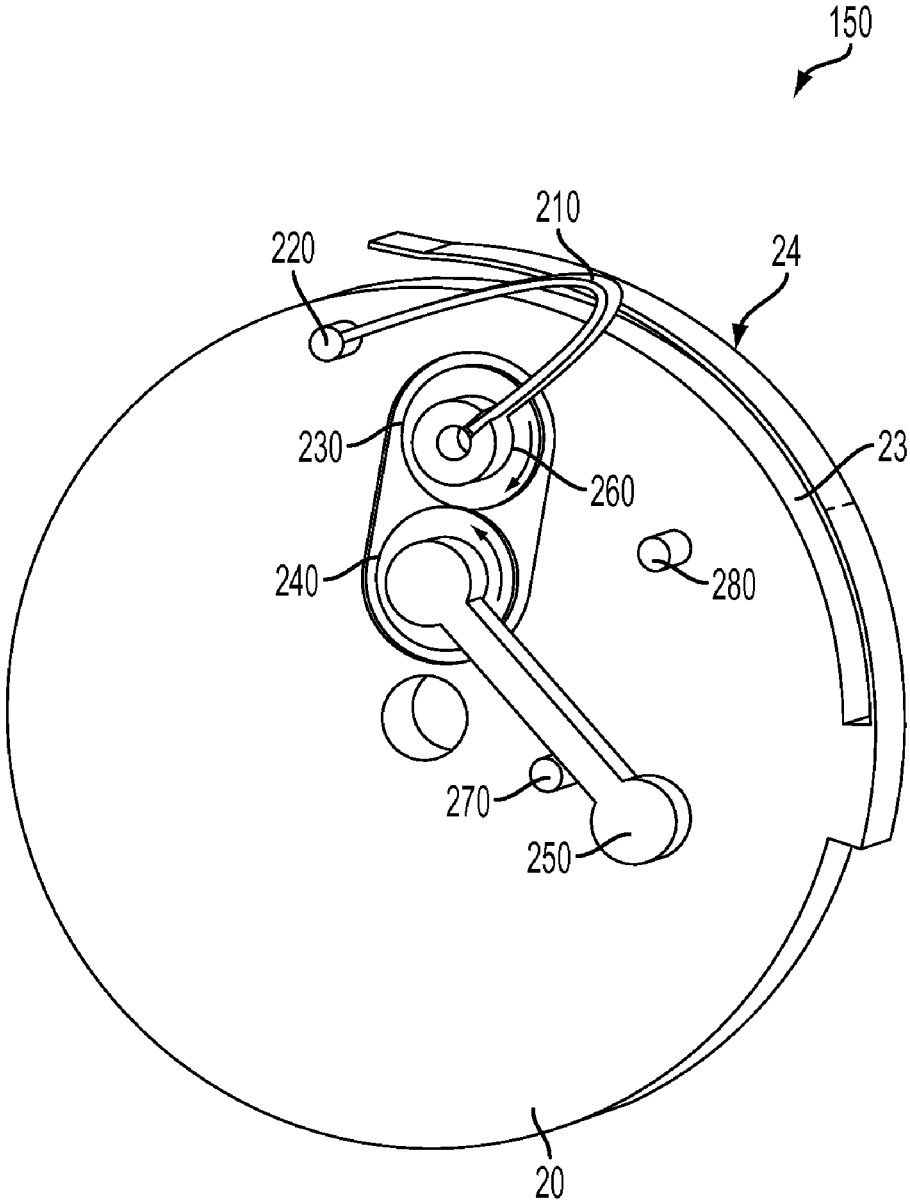
FIG. 2 is an enlarged cross sectional view of a disk stacker with the gripper belt loop in the print media entry position in accordance to an embodiment.

FIG. 2 is an enlarged cross sectional view of a disk stacker with gripper belt loop in the print media removal position in accordance to an embodiment. The gripper belt loop mechanism 150 comprises a gripper surface 210, an anchor 220 for the gripper surface, a cam mechanism 230, a gear 240, a counter weight arm 250, a first post 270, and a second post 280.

The gripper surface 210 is fashioned into a belt loop with an elastomer material having a compressible outer surface, such as any of the well-known silicone-based elastomers or high temperature cellular foam or low to medium rubber having textured surface for high friction. The particular elastomer material chosen depends largely on the desired or required degree of compression to which the surface will be subjected. It is particularly preferable that the material is an elastomer material containing hard segments and soft segments so as to provide both high wear resistance and high cracking resistance. The ends of the elastomer material are anchored at post 220 and at cam 230. The softer material is oriented such to allow media insertion but prevent ease of removal due to the locking type of motion and force created by the gripping surface 210 if the media is pulled against the media entry direction. The orientation creates a rib or protrusion extending radially outward from the inner side of slot 23. Thus, as a print media is inserted into slot 23 the leading edge of the sheet causes the protrusion to flex out of the way during insertion yet the gripping surface 210 would provide an increasing force if the media is attempted to be removed. A clockwise movement 260 of cam 230 would cause gripping surface 210 to move downward or away from finger 24. The downward movement of gripping surface 210 would lessen the force exerted on the print media. A movement of counter weight arm 250 away from post 270 causes gear 240 to rotate which then causes cam 250 to move gripping surface 210. The movement of gripping surface 210 when a print media is in slot 23 causes the exerted force to either increase or decrease based on the movement of the counter weight. The maximum exerted force from gripping surface 210 occurs when counter weight is at post 270 and the minimum exerted force occurs when the counter weight is at post 280. Posts 270 and 280 limit the exerted force to within a range of values; that is to an upper and lower force. Additionally, post 270 and post 280 prevent a coiling of gripping surface 210. Further, it is possible to tune the initial exerted force on the print media by gripping surface 210 by adjusting the tooth alignment between cam 230 and gear 240. The cam gear assembly translates the movement of the counter weight arm 250 into a force that keeps the print media secured in slot 23.

Figure 3:
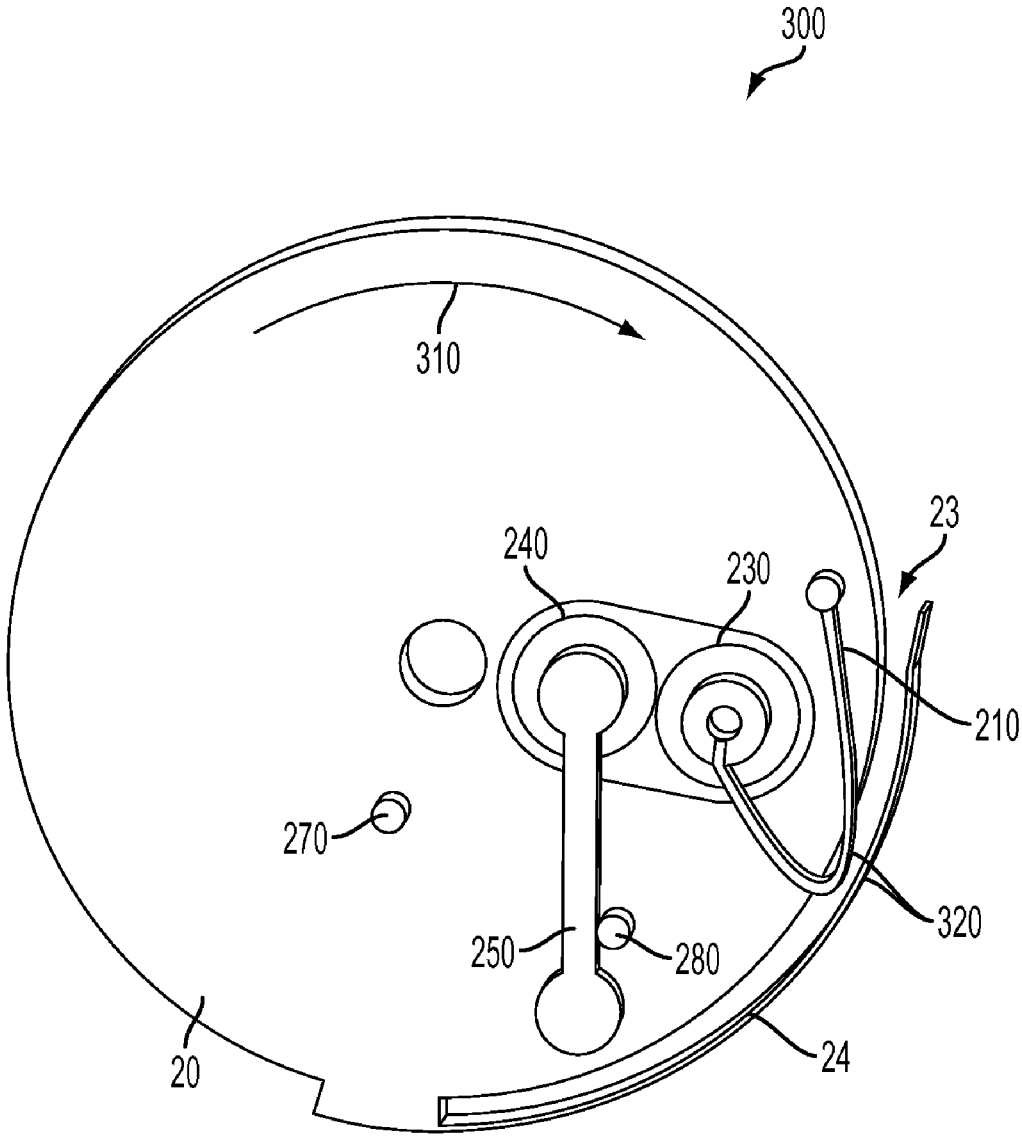
FIG. 3 is an enlarged cross sectional view of a disk stacker with the gripper belt loop in the print media removal position in accordance to an embodiment.
Figure 4:
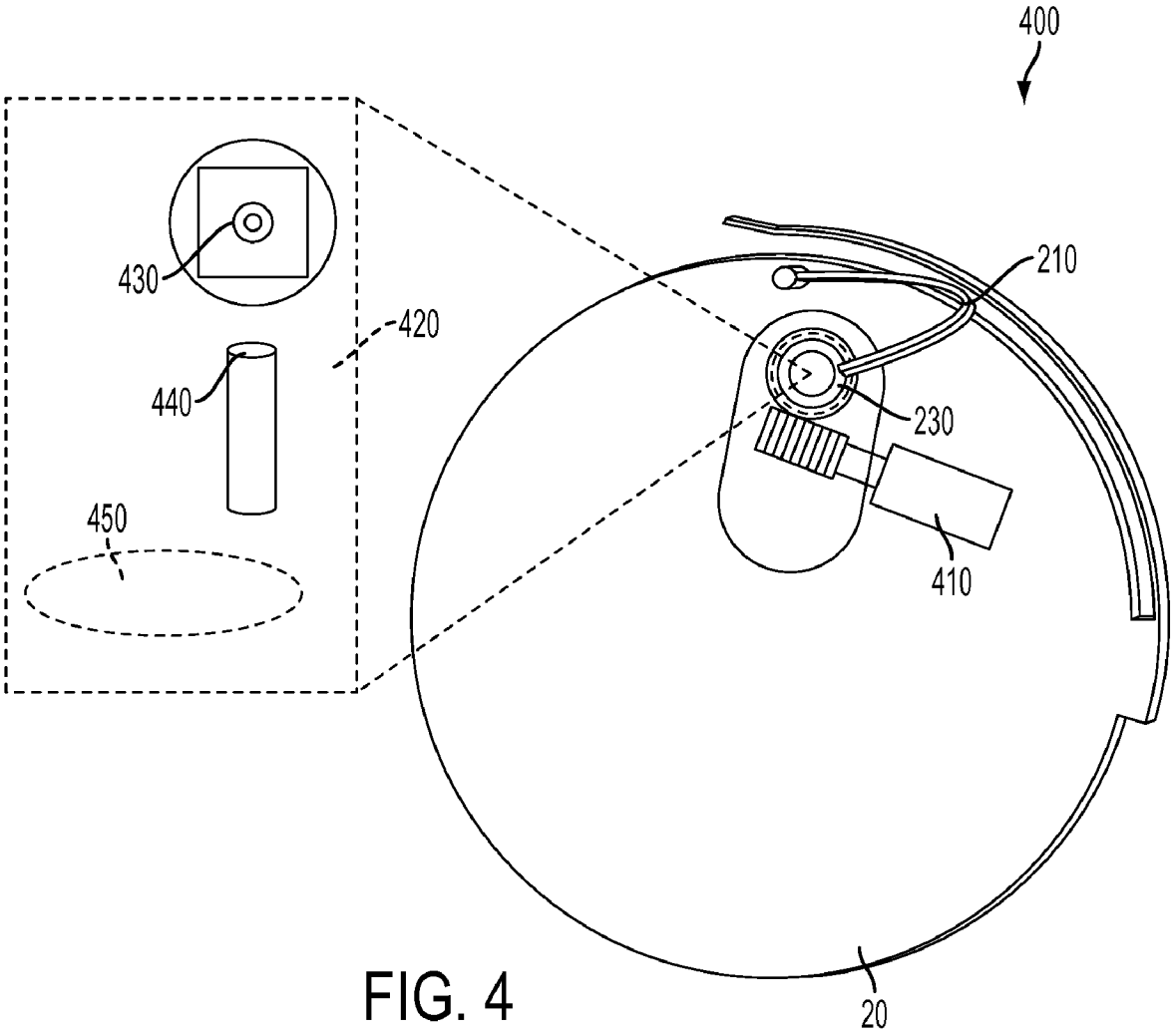
FIG. 4 is enlarged cross sectional view of a disk stacker, electromechanical movement mechanism, gripper belt loop, and cam in accordance to an embodiment.

FIG. 3 is an enlarged cross sectional view of a disk stacker and gripper belt loop in the print media removal position in accordance to an embodiment. This view depicts the orientation of the disk unit 20 when the print media is about to be tamped and removed from the retaining finger 24. As noted earlier Post 270 and post 280 allow the counterweight arm 250 to rotate freely between both ends. The counter weight arm 250 is always positioned in the lower portion of the rotating disk unit 20 due to the force of gravity. The disk unit 20 has rotated approximately 90.degrees clockwise 310, the counter weight arm 250 and gear have rotated, due to the gravitational effect, to the exit stop or post 280. The rotation of the counterweight arm 250 through cam 230 causes gripper surface 210 to be displaced away from finger 24. The rotation of the gripper surface 210 causes a gap 320 to develop and a reduction of the force applied to the print media. The gap facilitates tamping and removal without creating any scuff marks on the media FIG. 4 is enlarged cross sectional view of a disk stacker, electromechanical movement mechanism, gripper belt loop, and cam in accordance to an embodiment. The varying of the force exerted by gripper surface 210 is caused by a movement mechanism 410 with gear for rotating cam 230. It will be appreciated that any suitable driving mechanism can be used to rotate cam 230. A cam mechanism 420 placed underneath cam 230 has a pin holder 430, a cam pin 440, and groove 450 for allowing cam pin to rotate. A cam may be defined as a machine element having a curved outline or a curved groove that by oscillation or rotation motion gives a predetermined specified motion to another element. In the present arrangement movement mechanism 410 rotates cam 230 which in turn causes gripping surface 210 to move vertically through a range of positions.

Figure 5:
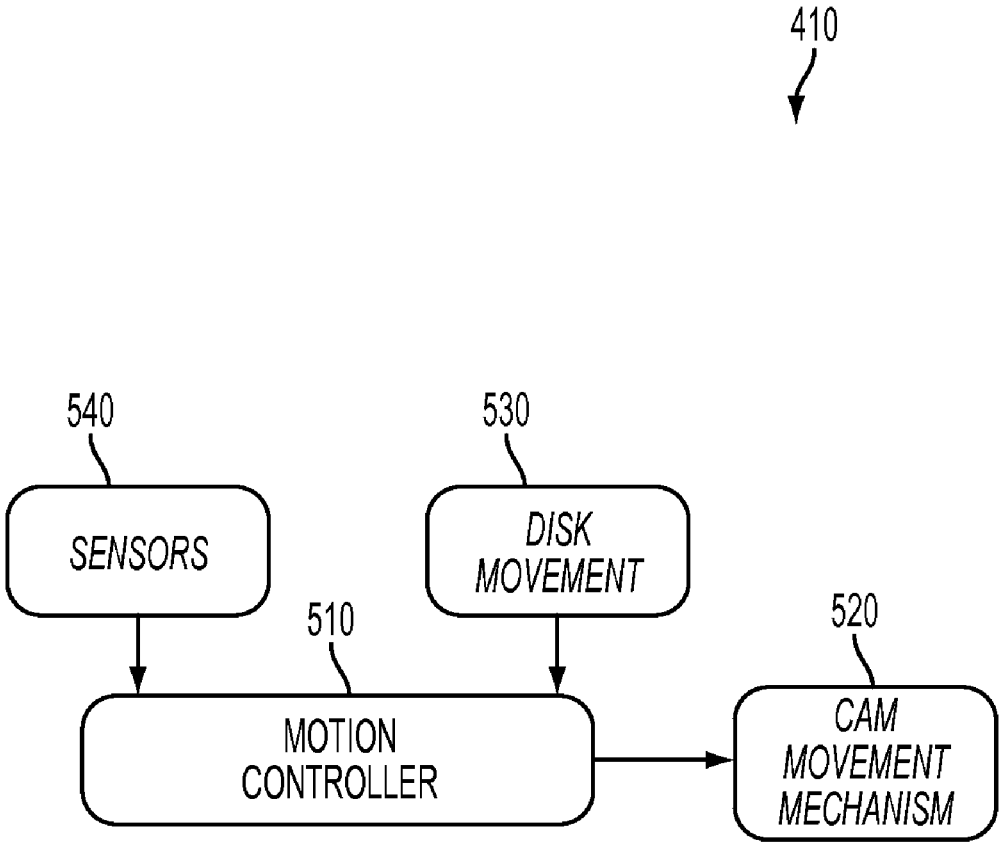
FIG. 5 is a block diagram of a motion controller for varying the gripper belt loop in accordance to an embodiment.

FIG. 5 is a block diagram of a motion controller 510 for varying the gripper belt loop in accordance to an embodiment. The motion controller 510 uses software, or computer-readable media (not shown) for timing control and movement of gripper surface 210 through cam movement mechanism 520. The timing control synchronizes the arrival of a print media into slot 23 with the exerted force of gripping surface 210. The timing control can be triggered by disk movement signal 530 and sensor signal 540 when it senses the lead edge of an advancing print media piece. The timer may be programmed to delay for a short period of time before it activates the movement of cam 230. The delay can be based on the distance and velocity of the print media as it moves through the feed mechanism. The movement of a cam in disk 20 can also be controlled by another motion controller (not shown). In addition, the motion controller of disk 20 can be synchronized to the movement of cam 230 through motion controller 510. Motion controller 510 and other controllers can form part of a workflow production system of a printer system which uses paper job requests, also known as paper job tickets, which are readable both by a human operator and by a controller. Specifications for the performance of tasks of a workflow that need to be performed by machines and a human operator (user) operating the machines are printed on a paper job request together with additional machine readable markings. The human operator performs the tasks, e.g., setting machine parameters or selectable settings, as specified on the paper job request, and marks the paper job request, as in a traditional work flow, with indications of the state of the task. The marked paper job request is scanned by a scanning device and the machine readable markings are interpreted by a workflow server managing the electronic job request. Motion controller and other controllers also include an operating system (not shown) that is stored on a computer-accessible media such as RAM, ROM, and mass storage device, and is executed by a processor in a controller. Examples of operating systems include Microsoft Windows®, Apple MacOS®, Linux®, and UNIX®. Examples are not limited to any particular operating system, however, and the construction and use of such operating systems are well known within the art.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A stacker for forming a stack of stackable items, comprising:

at least one rotational element, each rotational element having an outer periphery and at least one slot breaking into the outer periphery, each slot dimensioned for receipt of at least a portion of a stackable item;

a feed mechanism to receive a stackable item and to feed the stackable item into one of the at least one slot in the at least one rotational element;

a gripper surface positioned in relationship to the at least one rotational element so as to exert a force on the stackable item that has been received within the slot of the at least one rotational element; and a mechanical linkage coupled to the gripper surface being cooperable with the at least one rotational element to vary the force on the stackable item that has been received within the slot of the at least one rotational element, wherein the mechanical linkage comprises a counterweight arm to vary the gripper surface in a direction that increases or decreases the exerted force.

2. The stacker of claim 1, wherein the mechanical linkage includes a rotating cam coupled to one end of the gripper surface to vary the gripper surface in a direction that increases or decreases the exerted force.

3. The stacker of claim 2, wherein the gripper surface is an elastomer material being positioned to contact the stackable material.

4. The stacker of claim 1, further comprising:

a drive mechanism operatively connected to the counterweight arm and to the gripper surface.

5. The stacker of claim 4, wherein the drive mechanism comprises a cam and gear assembly.

6. The stacker of claim 5, further comprising:

a first and a second post configured to extend beyond a side surface of the rotational element, wherein the counterweight arm moves between the first and the second post.

7. The stacker of claim 6, wherein an initial force on the stackable item that has been received within the slot of the at least one rotational element can be set by the cam and gear assembly.

8. The stacker of claim 1, further comprising:

a rotating cam with post coupled to one end of the gripper surface to vary the gripper surface in a direction that increases or decreases the exerted force.

9. The stacker of claim 8, wherein the gripper surface is an elastomer material positioned to flex during insertion of the stackable item into the at least one slot in the at least one rotational element.

10. A printer system for printing and compiling a printed media, said printer comprising:

a tray for receiving a plurality of printed media from a media stacker; and a media stacker to stack a plurality of printed media in a stack, the media stacker comprising:

at least one rotational element, each rotational element having an outer periphery and at least one slot breaking into the outer periphery, each slot dimensioned for receipt of at least a portion of the compiled printed media;

a feed mechanism to receive a printed media and to feed the printed media into one of the at least one slot in the at least one rotational element;

a gripper surface positioned in relationship to the at least one rotational element so as to exert a force on the printed media that has been received within the slot of the at least one rotational element;

a mechanical linkage coupled to the gripper surface being cooperable with the at least one rotational element to vary the force on the printed media that has been received within the slot of the at least one rotational element, wherein the mechanical linkage comprises a counterweight arm to vary the gripper surface in a direction that increases or decreases the exerted force.

11. The printer system of claim 10, wherein the mechanical linkage includes a rotating cam coupled to one end of the gripper surface to vary the gripper surface in a direction that increases or decreases the exerted force.

12. The printer system of claim 11, wherein the gripper surface is an elastomer material being positioned to contact the stackable material.

13. The printer system of claim 10, further comprising:

a drive mechanism operatively connected to the counterweight arm and to the gripper surface.

14. The printer system of claim 13, wherein the drive mechanism comprises a cam and gear assembly.

15. The printer system of claim 14, further comprising:

a first and second post configured to extend beyond a side surface of the rotational element, wherein the counter-weight arm moves between the first and second post.

16. The printer system of claim 15, wherein an initial force on the printed media that has been received within the slot of the at least one rotational element can be set by the cam and gear assembly.

17. The printer system of claim 10, further comprising:

a rotating cam with post coupled to one end of the gripper surface to vary the gripper surface in a direction that increases or decreases the exerted force.

18. The printer system of claim 17, wherein the gripper surface is an elastomer material positioned to flex during insertion of the printed media into the at least one slot in the at least one rotational element.

* * * * *